US009085170B2

(12) United States Patent
Izawa et al.

(10) Patent No.: US 9,085,170 B2
(45) Date of Patent: Jul. 21, 2015

(54) PAPER CONVEYING APPARATUS WITH PAPER THREADING MODE FEEDING CONTINUOUS PAPER WITHOUT TENSION

(71) Applicants: Hideo Izawa, Narashino (JP); Seiko Sugiyama, Daisen (JP)

(72) Inventors: Hideo Izawa, Narashino (JP); Seiko Sugiyama, Daisen (JP)

(73) Assignee: MIYAKOSHI PRINTING MACHINERY CO., LTD., Narashino-shi (JP)

( * ) Notice: Subject to any disclaimer, the term of this patent is extended or adjusted under 35 U.S.C. 154(b) by 8 days.

(21) Appl. No.: 13/956,896

(22) Filed: Aug. 1, 2013

(65) Prior Publication Data

US 2014/0044469 A1 Feb. 13, 2014

(30) Foreign Application Priority Data

Aug. 9, 2012 (JP) ..... 2012-176608

(51) Int. Cl.

| | |
|---|---|
| ***B41F 13/03*** | (2006.01) |
| ***B41F 33/16*** | (2006.01) |
| ***B65H 23/192*** | (2006.01) |
| ***B41J 13/00*** | (2006.01) |
| ***B41F 13/02*** | (2006.01) |
| ***B65H 23/188*** | (2006.01) |

(52) U.S. Cl.

CPC ..... *B41J 13/0009* (2013.01); *B41F 13/02* (2013.01); *B41F 13/03* (2013.01); *B41F 33/16* (2013.01); *B65H 23/1888* (2013.01); *B65H 23/192* (2013.01); *B65H 2301/522* (2013.01); *B65H 2404/143* (2013.01); *B65H 2404/147* (2013.01); *B65H 2513/108* (2013.01); *B65H 2513/11* (2013.01); *B65H 2801/21* (2013.01)

(58) Field of Classification Search

CPC ..... B41F 13/03; B41F 33/06; B41F 13/02; B41F 33/16; B65H 2301/522; B65H 2301/52202

See application file for complete search history.

(56) References Cited

U.S. PATENT DOCUMENTS

| | | | | |
|---|---|---|---|---|
| 6,321,967 | B1 * | 11/2001 | Michalik et al. | 226/91 |
| 2004/0149799 | A1 * | 8/2004 | Ruckmann et al. | 226/91 |
| 2008/0058980 | A1 * | 3/2008 | Nakano | 700/122 |
| 2008/0264280 | A1 * | 10/2008 | Baggot et al. | 101/248 |
| 2009/0193989 | A1 | 8/2009 | Senoo | |

FOREIGN PATENT DOCUMENTS

JP 10-017186 A 1/1998

OTHER PUBLICATIONS

Partial European Search Report dated Mar. 6, 2014, issued in corresponding European Patent Application No. 13179270.7.

* cited by examiner

*Primary Examiner* — Daniel J Colilla

(74) *Attorney, Agent, or Firm* — Westerman, Hattori, Daniels & Adrian, LLP

(57) ABSTRACT

In a printing machine, it is enabled to prevent continuous paper from being broken when the continuous paper is initially fed through a path of its conveyance.

The paper conveying apparatus is provided that the path of conveyance of continuous paper 1 is provided with a first, a second and a third feed roll unit 5, 6 and 7, having their respective feed rates which when continuous paper is printed on and machined are controlled to increase in the order of the feed roll units to generate a proper amount of tension imparted thereto and which when the continuous paper is initially fed through the path are controlled to decrease in the order of the feed roll units so as not to generate tension whereby the continuous paper is prevented from being broken in the course of initial paper threading in the printing machine.

3 Claims, 3 Drawing Sheets

PAPER CONVEYING APPARATUS WITH PAPER THREADING MODE FEEDING CONTINUOUS PAPER WITHOUT TENSION

BACKGROUND OF THE INVENTION

1. Technical Field

The present invention relates to a paper conveying apparatus for conveying continuous paper in a printing machine for processing the continuous paper successively by from printing to machining such as punching or perforating.

2. Background Art

A printing machine for processing continuous paper successively by from printing to machining has hitherto been known which is provided with a paper feed section for feeding continuous paper, a printing section and a machining section in order in a path of continuous paper conveyance to perform printing, and machining of various sort on the way of continuous paper conveyance.

In the printing machine, it is important that a proper amount of tension be generated and imparted to continuous paper and the tension be unvaried in the printing and machining sections, to allow continuous paper to be conveyed in a stabilized state. The conventional paper conveying apparatus as disclosed in JP H10-17186 A is equipped with a first feed roll unit at an outlet side of the paper feed section, a second feed roll unit at an outlet side of the printing section and a third feed roll unit at an outlet side of the machining section, each having a feed rate (paper feed rate) set the larger the more downstream it is; for example, if the feed rate of the first feed roll unit is set at 100, the feed rate of the second feed roll unit is set at 100.01 and the feed rate of the third feed roll unit is set at 100.02, so that a proper amount of tension may be generated and imparted to continuous paper over the entire path of paper conveyance, thereby stabilizing the conveyance of paper.

To wit, due to a long path of continuous paper conveyance, a total conveyance resistance from the paper feed section to the machining section if it acts on continuous paper may break the continuous paper. To prevent this, the apparatus is so configured that with each of the first, second and third feed roll units constituted by a rotating roll and a nip roll made in pressure contact with each other, continuous paper after it is passed or fed through to each feed roll unit is caught between the rotating and nip rolls whereupon continuous paper between the first and second feed roll units has a conveyance resistance imparted thereto that is based on a difference in feed rate between them and continuous paper between the second and third feed roll units has a conveyance resistance imparted thereto that is based on a difference in feed rate between them, thereby feeding continuous paper consecutively under respective forces of conveyance of the feed roll units while preventing continuous paper from undergoing a total conveyance resistance that may be applied thereto from the paper feed section to the machining section.

In such a paper conveying apparatus of the printing machine in the prior art as mentioned above, it has been found to be still possible that with continuous paper being passed or fed through over the feed roll units when the printing machine starts to be driven (viz. in the course of initial paper threading), the continuous paper may be broken at a point on the way of conveyance.

To wit, with continuous paper from its leading end being then fed or passed successively between the rotating and nip rolls in pressure contact of the first, second and third feed roll units over the entire printing machine (all the sections therein), the tension imparted thereto is prone to be not uniform widthwise thereof (in a direction transverse to the direction of paper conveyance) at a point or points on the way of paper threading due to its meandering and such and consequently be locally larger as generated, causing continuous paper to be broken.

If continuous paper is broken on the way of a paper threading operation in the course of initial paper threading as mentioned above, the paper threading operation must be started again from the position of break, giving rise to an unscheduled operating time and thus lowering the efficiency of paper threading operation.

Especially in the case of printing and machining of continuous paper that is thin and/or has a line of perforations, the continuous paper is prone to break in the course of initial threading, making it prone to develop problems of an increased burden of operation, being time-consuming and wastefulness of paper.

In view of problems as mentioned above, it is an object of the present invention to provide a paper conveying apparatus in a printing machine, which is capable of generating a proper amount of tension and imparting it to continuous paper in the course of printing and machining, conveying continuous paper as the tension is held unvaried and stable in printing and machining sections, and preventing or restraining continuous paper from being broken in the course of initial paper threading.

DISCLOSURE OF THE INVENTION

In accordance with the present invention in a first aspect thereof a paper conveying apparatus in a printing machine which is provided in a path of conveyance of continuous paper with a printing section, a machining section, and a plurality of feed roll units for conveying continuous paper by feeding it while it is being caught in each of them, to successively print on and machine continuous paper while in conveyance by the feed roll units, characterized in that the paper conveying apparatus comprises:

a control means for individually controlling respective feed rates of the feed roll units, the control means having a printing mode and an initial paper threading mode, the control means when in the printing mode controlling the respective feed rates of the feed roll units so that the feed rate of a feed roll unit at a downstream side is larger than the feed rate of a feed roll unit at a side upstream thereof so as to generate a proper amount of tension and impart it to the continuous paper, the control means when in the initial paper threading mode controlling the respective feed rates of the feed roll units so that the feed rate of the feed roll unit at the downstream side is smaller than the feed rate of the feed roll unit at the side upstream thereof so as not to generate tension to the continuous paper.

The present invention provides in an second aspect thereof a paper conveying apparatus in a printing machine which is provided in a path of conveyance of continuous paper with a printing section, a machining section, and a plurality of feed roll units for conveying continuous paper by feeding it while it is being caught in each of them, to successively print on and machine continuous paper while in conveyance by the feed roll units, characterized in that the paper conveying apparatus comprises:

a control means for individually controlling respective feed rates of the feed roll units, the control means having a printing mode and an initial paper threading mode, the control means when in the printing mode controlling the respective feed rates of the feed roll units so that the feed rate of a feed roll unit at a downstream side is larger than the feed rate of a feed roll unit at a side upstream thereof so as to generate a proper amount of tension and impart it to the continuous paper, the control means when in the initial paper threading mode controlling the respective feed rates of the feed roll units so that the feed rate of the feed roll unit at the upstream side is identical to the feed rate of the feed roll unit at the side downstream thereof so as not to generate tension to the continuous paper.

The present invention provides in a third aspect thereof a paper conveying apparatus in a printing machine which is provided in a path of conveyance of continuous paper with a printing section, a machining section, and a plurality of feed roll units for conveying continuous paper by feeding it while it is being caught in each of them, to successively print on and machine continuous paper while in conveyance by the feed roll units, characterized in that the paper conveying apparatus comprises:

a control means for individually controlling respective feed rates of the feed roll units, the control means having a printing mode and an initial paper threading mode, the control means when in the printing mode controlling the respective feed rates of the feed roll units so that the feed rate of a feed roll unit at a downstream side is larger by a first rate increase than the feed rate of a feed roll unit at a side downstream thereof so as to generate a proper amount of tension and impart it to the continuous paper, the control means when in the initial paper threading mode controlling the respective feed rates of the feed roll units so that the feed rate of the feed roll unit at the downstream side is larger than the feed rate of the feed roll unit at the side upstream thereof by a second rate increase smaller than the first rate increase so as to generate a tension smaller than the tension to be generated in the said printing mode to the continuous paper.

Specifically in the paper conveying apparatus in a printing machine according to the present invention, each of the feed roll unit means has a rotating roll and a nip roll between which continuous paper is to be caught and to pass through while the rotating roll is being rotated, thereby conveying the continuous paper, and the control means is adapted to control a rotation rate of the rotating roll of each of the feed roll units independently of those of others to individually control a feed rate of each of the feed roll units, the rotation rate of the rotating roll of the feed roll unit at the downstream side being controlled with reference to the rotation rate of the rotating roll of the feed roll unit at the upstream side.

Consequently, it is ensured that continuous paper as it is caught between a rotating roll and a nip roll can be fed and conveyed.

Specifically in the paper conveying apparatus in a printing machine according to the present invention, the rotating roll of each of the feed roll units is adapted to be rotated by an independent motor, the control means has the printing mode in which a rotating roll has a rotation rate set to correspond to a feed rate set for printing on and machining continuous paper and the initial paper threading mode in which a rotating roll has a rotation rate set to correspond to a feed rate set for initially feeding continuous paper through the path, a rotating roll is rotatable in the printing mode at the rotation rate set for the printing mode, and a rotating roll is rotatable in the initial paper threading mode at the rotation rate set for the initial paper threading mode.

This facilitates controlling the respective feed rates of the feed roll units.

According to the present invention in the first, second and third aspects thereof in which when the control means is in the printing mode, the feed rate of a feed roll unit at a downstream side is made larger than the feed rate of a feed roll unit at an upstream side, generating a proper amount of tension and imparting it to continuous paper in the course of printing and machining, it is possible to convey continuous paper in a stabilized state under the tension that is proper and held unvaried in the printing and machining sections.

According to the present invention in the first and second aspects thereof whereby when the control means is in the initial paper threading mode, tension is not generated to continuous paper, it is ensured that continuous paper during the course of initial paper threading can be prevented from being broken.

According to the present invention in the third aspect thereof whereby a tension as generated and imparted to continuous paper when the control means is in the initial paper threading mode is made smaller than a tension to be generated and imparted to continuous paper when the control means is in the printing mode, it is possible to restrain continuous paper in the course of initial paper threading from being broken.

Accordingly, the frequency of needs for a wasteful repetitive paper threading operation from a position of paper at which it may otherwise be broken is diminished, reducing an operational burden, avoiding waste of operating time and enhancing the efficiency of operations.

And, improvements in the efficiency of operation heighten the productivity. Lesser the broken paper becomes, the lesser the loss of paper becomes, reducing the production cost.

Especially in the case of printing and machining thin paper or paper formed with perforations, tremendous improvements can be achieved in aspects of reducing occurrence of loss of paper and rendering the preparatory operations efficient.

BEST MODES FOR CARRYING OUT THE INVENTION

Figure 1:
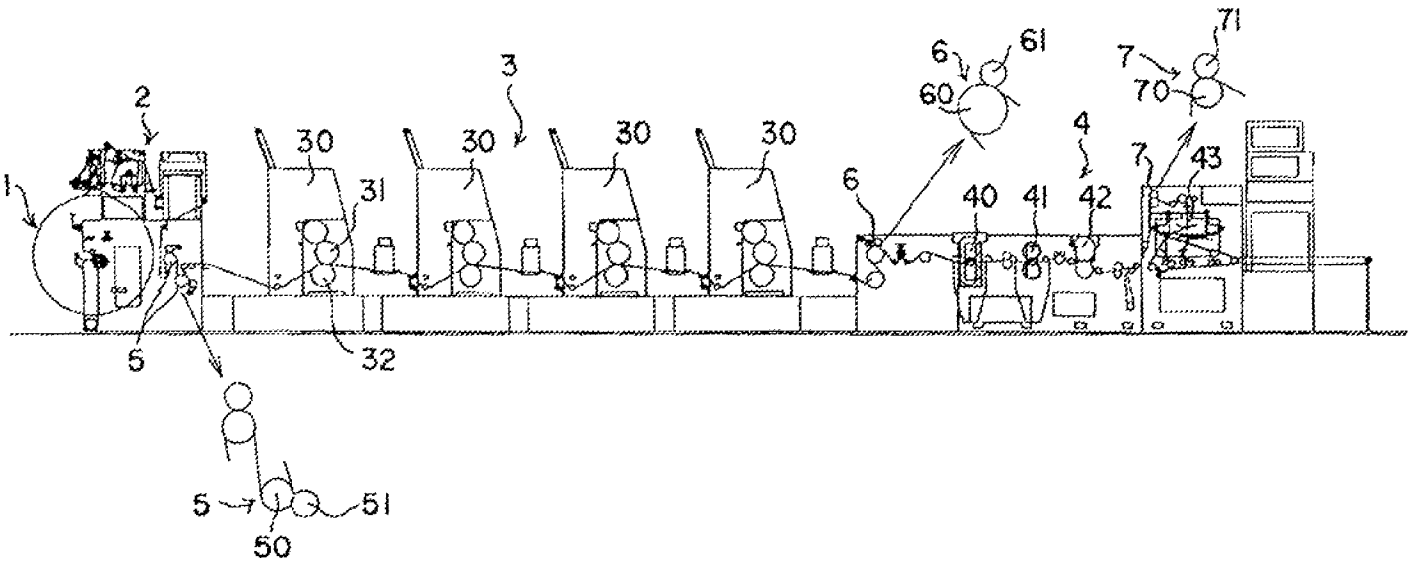
FIG. 1 is an explanatory view of a printing machine which includes a first form of implementation of the paper conveying apparatus of the present invention.

FIG. 1 illustrates one form of the printing machine which includes a paper feed section 2 for feeding continuous paper 1 into a path of conveyance, a printing section 3 and a machining section 4 for processing continuous paper 1 successively by from printing to machining.

The printing section 3 here has four printing units (printers) 30 with which continuous paper 1 is printed on in four colors.

Each of the printing units 30 has a printing cylinder 31 and an impression cylinder 32, the printing and impression cylinders 31 and 32 being held in pressure contact with each other in printing on continuous paper 1 and being spaced from each other when continuous paper 1 is passed or fed through the machine before printing and machining.

The machining section 4 may comprise a punching unit 40 for punching a hole in continuous paper 1, a longitudinal perforator 41 for forming a series of longitudinal perforations in continuous paper 1 and a transverse perforator 42 for forming a series of transverse perforations in continuous paper 1, and further a folding unit (folding machine) 43 for folding continuous paper 1.

The printing machine should not be limited to that described above. For example, the printing section 3 may comprise three printing units 30, the machining section 4 may not include the folding unit 43, and such.

Figure 2:
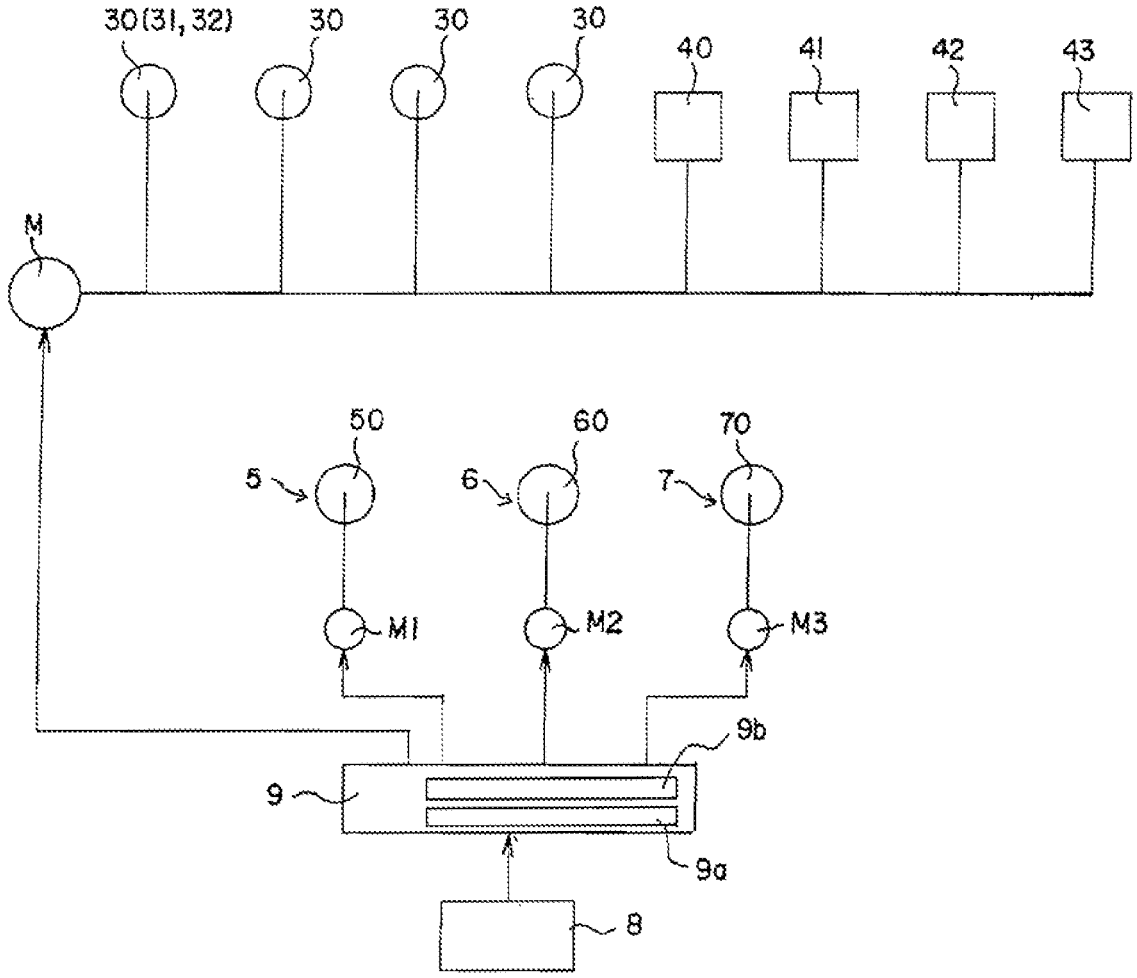
FIG. 2 is an explanatory view illustrating one control device for the paper conveying apparatus.

The printing and impression cylinders 31 and 32 of each printing unit 30, the punching unit 40, the longitudinal perforator 41, the transverse perforator 42 and the folding unit 43 are synchronously driven and controlled. For example, they may be synchronously driven and controlled by a main motor M as shown in FIG. 2.

Next, mention is made of a first form of implementation of the paper conveying apparatus of the present invention.

The paper feed section 2 is provided at its feed-out or outlet side with a first feed roll unit 5 with which continuous paper 1 is fed and conveyed towards the printing section 3.

The printing section 3 is provided at its outlet side with a second feed roll unit 6 with which continuous paper 1 is fed and conveyed towards the machining section 4.

The machining section 4 is provided midway of the path of paper conveyance between the transverse perforator 42 and the folding unit 43 with a third feed roll unit 7 with which continuous paper 1 is fed and conveyed towards the folding unit 43.

The first feed roll unit 5 has a rotating roll 50 and a nip roll 51 between which continuous paper 1 is caught and with which it is fed and conveyed.

The second, third feed roll 6, 7 likewise has a rotating roll 60, 70 and a nip roll, 61, 71 between which continuous paper 1 is caught and with which it is fed and conveyed.

The first, second and third feed roll units 5, 6 and 7 so arranged ensures that continuous paper 1 can be fed and conveyed.

The first, second and third feed roll units 5, 6 and 7 are designed to be driven and controlled independently from each other so that the distances of conveyance of continuous paper 1 that are fed and conveyed by them per unit time, viz. their feed rates, may each be controlled individually.

For example, a first, a second and a third motor M1, M2 and M3 that can be driven and controlled independently of each other may be provided and connected as shown in FIG. 2 to directly rotate the rotating roll 50 of the first feed roll unit 5, to directly rotate the rotating roll 60 of the second feed roll unit 6 and to directly rotate the rotating roll 70 of the third feed roll unit 7, respectively, permitting the rotating rolls 50, 60 and 70 to rotate at different rotation rates and thereby the feed rates of the first, second and third feed roll units 5, 6 and 7 to be individually controlled.

Individually controlling the respective rotating rolls 50, 60 and 70 with the first, second and third motors M1, M2 and M3 which are independent of each other facilitates controlling the feed rates of the first, second and third feed roll units 5, 6 and 7.

The first, second and third motors M1, M2 and M3 are driven each in synchronism with a rotation signal to the main motor M.

For example, with a drive mode selection signal entered from an operating unit 8 into a control unit 9 as shown in FIG. 2, the control unit 9 acts to furnish the main motor M and the first, second and third motors M1, M2 and M3 with rotation drive control signals, respectively, to synchronously rotate them.

The first, second and third feed roll units 5, 6 and 7 are rotation-drive controlled in a mode of printing when printing and machining are performed and in a mode of initial paper threading when continuous paper from its leading end is initially passed or fed through.

In the printing mode, the first, second and third feed roll units 5, 6 and 7 have their feed rates controlled to increase in the order of their positions from upstream towards downstream.

For example, with the feed rate of the first feed roll unit 5 set at 100, the feed rate of the second feed roll 6 is set at 100.01 and the feed rate of the third feed roll unit 7 is set at 100.02. The tension of continuous paper 1 between the first and second roll units 5 and 6 (in the printing section 3) is set at a magnitude that corresponds to a difference (0.01) between the feed rate (100) of the first feed roll unit 5 and the feed rate (100.01) of the second feed roll unit 6. And, the tension of continuous paper 1 between the second and third roll units 6 and 7 is set at a magnitude that corresponds to a difference (0.01) between the feed rate (100.01) of the first feed roll unit 6 and the feed rate (100.02) of the third feed roll unit 7.

This allows generating a proper amount of tension and imparting it to continuous paper over the entire path of paper conveyance and developing a state of printing operation in which continuous paper 1 can be conveyed stably while the tension is held unvaried in the printing and machining sections 3 and 4.

In the initial paper threading mode, the first, second and third feed roll units 5, 6 and 7 have their feed rates controlled to decrease in the order of their positions from upstream towards downstream.

For example, if the feed rate of the first feel roll unit 5 is set at 100, the feed rate of the second feed roll unit 6 is set at 99.99 and the feed rate of the third feed roll unit 7 is set at 99.98 whereby no tension is generated to continuous paper between the first and second feed roll units 5 and 6 and to continuous paper between the second and third feed roll units 6 and 7, with only a force of feed or conveyance applied to continuous paper for its conveyance.

To wit, the feed rates of the first, second and third feed roll units 5, 6 and 7 are set at values such that while a force of feed is applied to continuous paper 1 for paper conveyance, no tension thereto is created over the entire path of paper conveyance.

This ensures that when continuous paper from its leading end is initially passed or fed through along the path of paper conveyance, or through the machine, the continuous paper is prevented from being broken due to its meandering in the sections on the way of the path of paper conveyance.

A form of implementation of controlling the feed rates of the first, second and third feed roll units 5, 6 and 7 is configured so that the control unit 9 is provided with the printing mode 9*a* and the initial paper threading mode 9*b* as shown in FIG. 2 and that the control unit 9 in response to an initial paper threading signal may select the initial paper threading mode 9*b* and in response to a printing signal may select the printing mode 9*a*.

And, when the initial paper threading mode 9*b* is selected, the first, second and third motors M1, M2 and M3 are drive-controlled so as to rotate at pre-established rotation rates for the respective rotating rolls 50, 60 and 70 to rotate at rotation rates such as to yield the preset feed rates (100, 99.99 and 99.98).

To wit, with the rotation rate of a rotating roll at an upstream side taken as a reference, the rotation rate of a rotating roll at its downstream side is controlled.

When the printing mode 9*a* is selected on the other hand, the first, second and third motors M1, M2 and M3 are drive-controlled so as to rotate at pre-established rotation rates for printing for the respective rotating rolls 50, 60 and 70 to rotate at rotation rates such as to yield the preset feed rates (100, 100.01 and 100.02).

To wit, with the rotation rate of a rotating roll at an upstream side taken as a reference, the rotation rate of a rotating roll at its downstream side is controlled.

For example, with an initial paper threading signal entered from the operating unit 8 into the control unit 9, let the initial paper threading mode 9*b* be selected.

And, upon visually confirming that continuous paper 1 has been passed or fed up to the most downstream of the machining section 4, let a printing signal be entered from the operating unit 8 into the control unit 9 to switch to the printing mode 9*a*. Alternatively, a sensor upon detecting that continuous paper 1 has been passed or fed up to the most downstream of the machining section 4 may issue a signal of the detection that is entered as a printing signal into the control unit 9.

Switching from the initial paper threading mode 9*b* to the printing mode 9*a* after the initial paper threading in this manner facilitates shifting to a state of printing operation that the proper amount of tension to continuous paper is being generated.

While in the form of implementation mentioned above, the rotating rolls 50, 60 and 70 of the first, second and third feed roll units 5, 6 and 7 are drive-controlled by the independent first, second and third motors M1, M2 and M3, respectively, to individually control the feed rates, it should be noted that this is not a limitation of the present invention.

Figure 3:
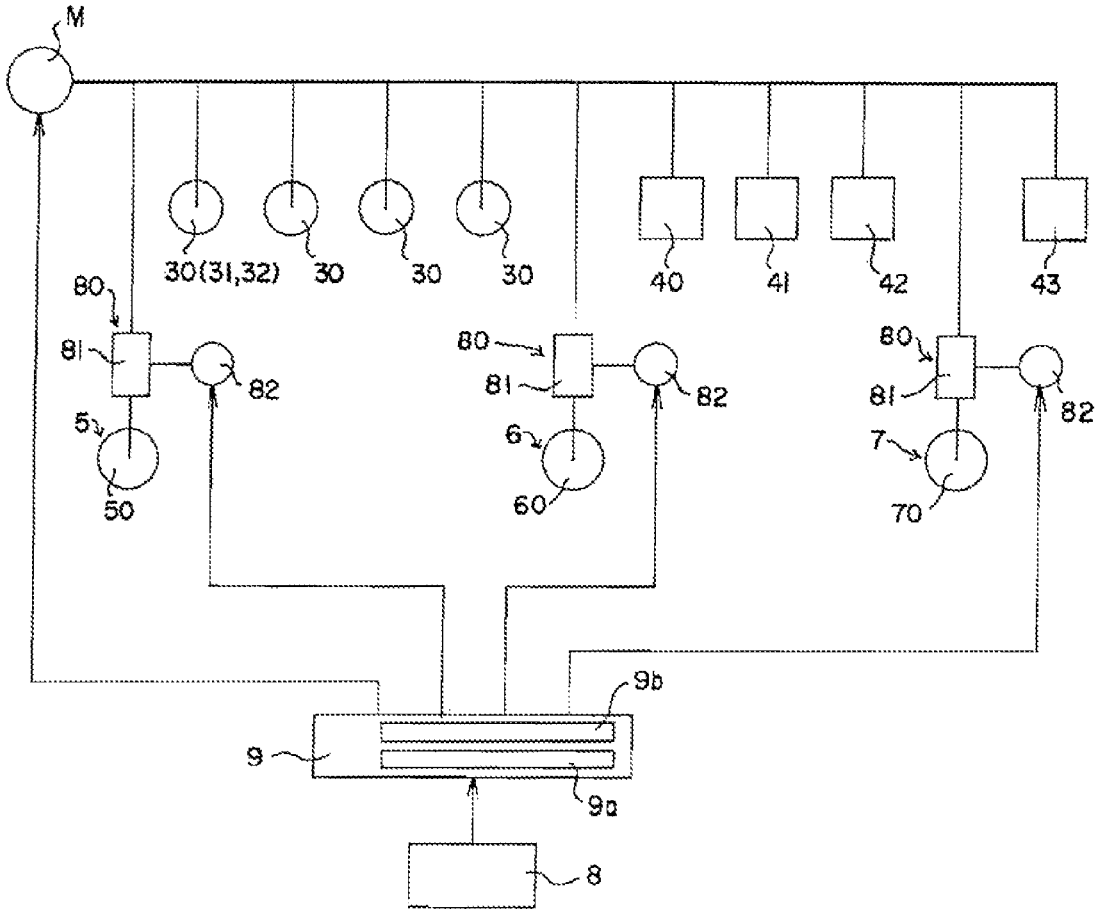
FIG. 3 is an explanatory view illustrating another control device for the paper conveying apparatus.

For example, the main motor M may as shown in FIG. 3 be connected to the rotating rolls 50, 60 and 70 via differential mechanisms 80 which may be controlled to control rotation rates of the rotating rolls 50, 60 and 70, thereby individually controlling the feed rates of the first, second and third feed roll units 5, 6 and 7.

The differential mechanism 80 may comprise a differential device 81 such as a planet gear or a harmonic drive mechanism and a motor 82 where the motor 82 is rotation-controlled so that they may develop differences in rotation rate between the main motor M and the rotating rolls 50, 60 and 70.

In this case, by controlling the rotation of the motor 81 depending on the printing mode 9*a* and the initial paper threading mode 9*b*, the feed rates of the first, second and third feed roll units 5, 6 and 7 are individually controlled as mentioned above.

Next, mention is made of a second form of implementation of the present invention.

In this form of implementation, the printing machine is like that shown in FIG. 1, the paper conveyance control apparatus for the printing machine is like that shown in FIG. 2 or 3, and the control operation performed by the control unit 9 upon selection of the printing mode 9*a* is like as mentioned above but the control operation by the control unit 9 upon selection of the initial paper threading mode 9*b* is performed differently from that mentioned above.

To wit, when the initial paper threading mode 9*b* is selected, the feed rates of the first, second and third feed roll units 5, 6 and 7 are made identical to each other so that no tension to continuous paper 1 may be generated.

For example, by driving the first, second and third motors M1, M2 and M3 to rotate at an identical rotation rate and in turn to rotate the rotating rolls 50, 60 and 70 at an identical rotation rate, the feed rates of the first, second and third feed roll units 5, 6 and 7 are made identical to each other.

Next, mention is made of a third form of implementation of the present invention.

In this form of implementation, the printing machine, the paper conveyance control apparatus and the control operation performed upon selection of the printing mode are like those in the first form of implementation mentioned above, but the control operation upon selection of the initial paper threading mode is performed differently from that in the abovementioned first form of implementation.

To wit, it is set that when the initial paper threading mode 9*b* is selected, the feed rates of the first, second and third feed roll units 5, 6 and 7 are increased in the order of their positions from upstream towards downstream by an increase or increases of feed rate which are smaller than that or those when the printing mode 9*a* is selected so that a tension generated to continuous paper is smaller anywhere than the tension when the printing mode 9*a* is selected.

For example, let it be assumed that when the printing mode 9*a* is selected, the rotation rate of the first motor M1 is V1, the rotation rate of the second motor M2 is V2 (where V1<V2), and the rotation rate of the third motor M3 is V3 (where V2<V3); and the feed rate of the first feed roll unit 5 is L1, the feed rate of the second feed roll unit 6 is L2 (where L1<L2) and the feed rate of the third feed roll unit 7 is L3 (where L2<L3). When the initial paper threading mode 9*b* is selected, it is set that the rotation rate of the first motor M1 is V4 (where V4=V1), the rotation rate of the second motor M2 is V5 (where V5<V2) and the rotation rate of the third motor M3 is V6 (where V6<V3); and the feed rate of the first feed roll unit 5 is L4 (where L4=L1), the feed rate of the second feed roll unit 6 is L5 where L5<L2) and the feed rate of the third feed roll unit 7 is L6 (where L6<L3) wherein increases of feed rate (L5−L4) and (L6−L5) are smaller than increases of feed rate (L2−L1) and (L3−L2), respectively, when the printing mode 9*a* is selected.

Consequently, it follows that a tension generated and imparted to continuous paper between the first feed roll unit 5 and the second feed roll unit 6 and a tension generated and imparted to continuous paper between the second feed roll unit 6 and the third feed roll unit 7 while the continuous paper is initially passed or fed through the path are made smaller than the tension while the continuous paper is in the course of printing and machining.

Accordingly, it is ensured that continuous paper in the course of initial paper threading can be prevented or restrained from breaking due to a small magnitude of tension thereto as caused by occurrence of its meandering and such in a section on the way of its conveyance.

While in the forms of implementation described above, the feed roll units are shown provided at three places, they may be provided at four places. The tension generated and imparted to continuous paper 1 is determined by a value of difference of the feed rates of adjacent feed roll units. As in the first, second and third forms of implementation, the feed rates of the feed roll units can be variably set so that in the course of printing and machining a proper amount of tension may be generated over the entire path of conveyance to convey continuous paper stably and in the course of initial paper threading the continuous paper may be prevented from breaking or restrained from breaking to reduce the frequency of paper breaks.

What is claimed is:

1. A paper conveying apparatus for conveying continuous paper in a printing machine which is provided with a printing section, a machining section, and a plurality of feed roll units for conveying the continuous paper by feeding the continuous paper in the printing section and the machining section while the continuous paper is caught in the feed roll units so as to successively print on and machine the continuous paper while in conveyance by the feed roll units, characterized in that the paper conveying apparatus comprises:

a control means for individually controlling respective feed rates of said feed roll units, said control means having a printing mode and an initial paper threading mode, said control means when in said printing mode controlling the respective feed rates of the feed roll units so that the feed rate of a said feed roll unit at a downstream side is larger than the feed rate of a said feed roll unit at a side upstream thereof so as to generate a proper amount of tension and impart it to the continuous paper, said control means when in said initial paper threading mode controlling the respective feed rates of the feed roll units so that the feed rate of said feed roll unit at the downstream side is smaller than the feed rate of said feed roll unit at the side upstream thereof so as not to generate tension to the continuous paper.

2. A paper conveying apparatus in the printing machine as set forth in claim 1, characterized in that:

each of the plurality of the feed roll units has a rotating roll and a nip roll between which continuous paper is caught and passed through while the rotating roll is being rotated, thereby conveying the continuous paper, and said control means is adapted to control a rotation rate of the rotating roll of each of the feed roll units independently of the rotating roll of the other respective feed roll units to individually control a feed rate of each of the feed roll units, the rotation rate of the rotating roll of said feed roll unit at the downstream side being controlled with reference to the rotation rate of the rotating roll of said feed roll unit at the upstream side.

3. A paper conveying apparatus in the printing machine as set forth in claim 2, characterized in that:

the rotating roll of each of said feed roll units is adapted to be rotated by an independent motor, said control means has said printing mode in which a said rotating roll has a rotation rate set to correspond to a said feed rate set for printing on and machining continuous paper and said initial paper threading mode in which a said rotating roll has a rotation rate set to correspond to a said feed rate set for initially feeding continuous paper through the path, a said rotating roll is rotatable in said printing mode at said rotation rate set for the printing mode, and a said rotating roll is rotatable in said initial paper threading mode at said rotation rate set for the initial paper threading mode.

* * * * *